US005876028A

United States Patent [19]

Francke et al.

[11] Patent Number: 5,876,028

[45] Date of Patent: Mar. 2, 1999

[54] LETTER STACKER

[75] Inventors: Jurgen Francke, Berlin; Peter Bretschneider, Birkenwerder, both of Germany

[73] Assignee: Siemens Aktiengesellschaft, München, Germany

[21] Appl. No.: 860,735

[22] PCT Filed: Oct. 22, 1996

[86] PCT No.: PCT/EP96/04583

§ 371 Date: Oct. 22, 1997

§ 102(e) Date: Oct. 22, 1997

[87] PCT Pub. No.: WO97/17275

PCT Pub. Date: May 15, 1997

[30] Foreign Application Priority Data

Nov. 3, 1995 [DE] Germany ..... 195 40 964.7

[51] Int. Cl.[6] ..... B65H 5/22

[52] U.S. Cl. ..... 271/3.12; 271/3.01; 414/923

[58] Field of Search ..... 271/3.01, 3.12, 271/34, 201, 177, 213, 215, 198; 414/923

[56] References Cited

U.S. PATENT DOCUMENTS

| | | | |
|---|---|---|---|
| 3,682,473 | 8/1972 | Kuyt | 271/201 |
| 3,690,474 | 9/1972 | Kloppenecker | 271/201 |
| 4,299,379 | 11/1981 | Preston et al. | 271/3.01 |
| 4,735,407 | 4/1988 | Ozawa | 271/3.12 |

FOREIGN PATENT DOCUMENTS

| | | | |
|---|---|---|---|
| 23 54 107 | 5/1975 | Germany . | |
| 376848 | 5/1964 | Switzerland | 271/3.12 |
| 481686 | 1/1970 | Switzerland | 271/3.01 |

*Primary Examiner*—H. Grant Skaggs
*Attorney, Agent, or Firm*—Kenyon & Kenyon

[57] ABSTRACT

In a device for stacking flat letters having a separating mechanism and a stacking mechanism between which the letters are stacked, the stacking mechanism capable of moving in the stacking direction along a stacking surface, and a transport path that is formed by endless vertical belts guided by way of rollers, between which belts the letters are conveyed from a loading station to the stacking mechanism, it is provided that the stacking surface has a horizontal concave curvature with respect to the side on which the transport path is located, and that the belts are deflected in the region of the transport path by a plurality of deflecting rollers that are disposed on a curve adapted to the curvature of the stacking surface in such a way that the transport path has a curvature adapted to that of the stacking surface, in the region of the transport path, the belts being disposed between the stacking surface and the deflecting rollers.

19 Claims, 3 Drawing Sheets

LETTER STACKER

BACKGROUND OF THE INVENTION

The invention relates to an apparatus for stacking flat letters.

In letter-processing systems, it is often necessary to store letters temporarily between two processing cycles. For example, for coupling asynchronously-working systems or parts, storage apparatus are used. One letter-storing technique involves temporarily stacking the letters.

Normally, a stacker comprises a stationary separating mechanism and a stacking mechanism that can move in the stacking direction, the letters being stacked therebetween. The base of the letter stack is formed by a stacking surface. Two endless belts that circulate around rollers form a transport path that conveys the individually-arriving letters to the end of the stack.

Between the stacking mechanism and the letter-loading loading station, the two belts form a straight section of the transport path on which the belts run freely, i.e., they are not guided by rollers in that section. The length of this partial section of the transport path is dependent on the momentary position of the stacker mechanism during the stacking process. As the letter stack grows, this partial section is shortened proportionally. It reaches its maximum length if there is no letter stack and the stacking mechanism is located directly at the separating mechanism.

Given a comparable engineering outlay, the storage capacity achievable with this design is, in fact, greater than that attainable with imbricated storage, where the letters are squeezed one on top of the other, in imbricated form, between belts. However, when working with the above-described type of apparatus, problems arise when the straight partial section of the transport path reaches its maximum length. In such a case, the situation may arise that a plurality of letters are located on the partial section at the same time. If this occurs in a manner such that a thin letter is situated between two thick letters on the straight section, the thin letter is not securely held by the belts. If a plurality of letters are situated between two thick letters, it can happen that the thin ones shift over on top of each other, causing a jam in the transport path and an interruption in the operation of the system. An additional problem is that the free-running belts hang increasingly lower as the length of the partial section in the transport path increases. Both problems may lead to a maximum stacker length of one meter for the type of stacker apparatus described above.

SUMMARY OF THE INVENTION

The object of the present invention is to provide a stacker apparatus with which larger storage capacities can be attained.

An embodiment of the invention entails securely holding the letters between the belts of the transport path by means of a curved transport path, and by providing multiple deflection of the belts around the rollers in the region of the transport path, ensuring free movement of the stacking mechanism because the belts are disposed between the stacking surface and the deflecting rollers in the region of the transport path. An apparatus according to this embodiment of the invention therefore has a stacking surface possessing a horizontal, concave curvature with respect to the side on which the transport path is located. The belts in the region of the transport path are deflected by a number of deflecting rollers that are arranged on a curve that has a curvature essentially the same as the stacking surface curvature so that the transport path has a curvature essentially the same as the curvature of the stacking surface, the belts being disposed between the stacking surface and the deflecting rollers in the region of the transport path.

In one preferred specific embodiment of the invention, the stacking surface is essentially annular. The stacking surface may comprise a number of segments or may be embodied as a rigid disk. In one particularly preferable embodiment of the invention, belt bridges are provided at the stacking mechanism and at the loading station, by means of which bridges the outer belt is guided above or below the transport path. In other specific embodiments of the invention, both belts are guided together by means of the same deflecting rollers that are also used by the transport path, or by means of additional deflecting rollers disposed inside the ring formed by the transport path. In a further, preferred embodiment of the invention, the apparatus comprises a plurality of similar segments, with the exception of the region of the loading station and of the separating mechanism.

DETAILED DESCRIPTION OF THE DRAWINGS

Figure 1:
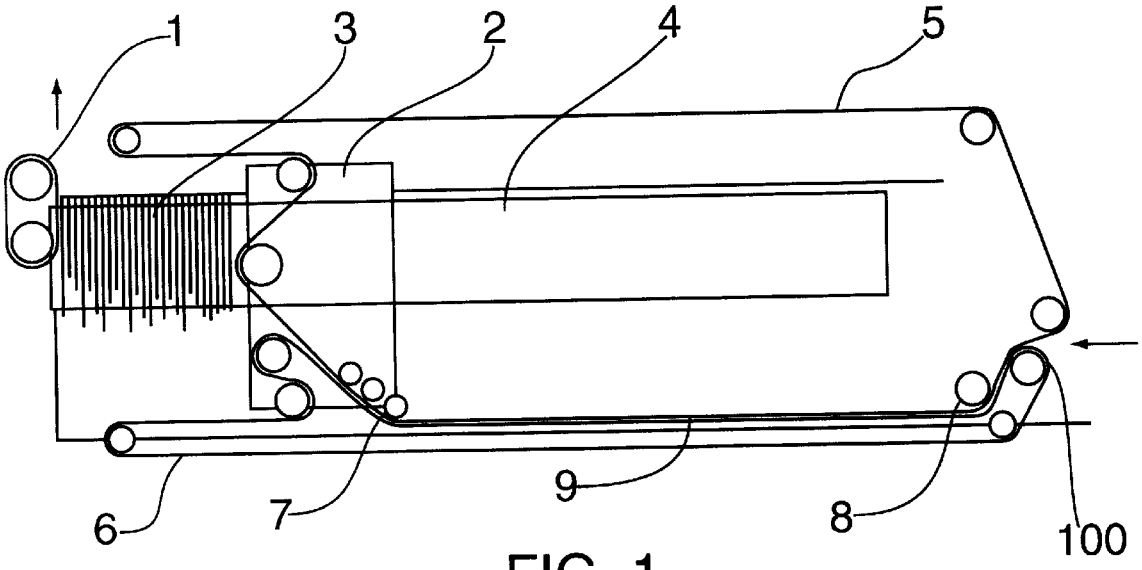
FIG. 1 shows a stacker apparatus.
Figure 2:
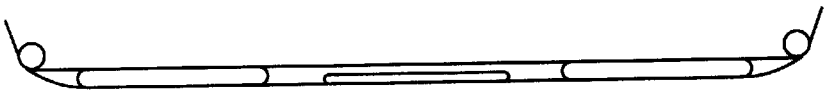
FIG. 2 shows a detailed view of the transport path 9 of the stacker apparatus of FIG. 1.

In the apparatus for stacking flat letters which is illustrated in FIG. 1, a separating mechanism 1 pulls off letters, as needed, that are stacked in a stack 3 between said separating mechanism 1 and a stacking mechanism 2. Stacking mechanism 2 is movable in the stacking direction. The base of a letter stack is formed by a stacking surface 4, preferably configured as a circulating conveyor belt. Two endless belts 5, 6 circulate around rollers. They form a transport path 9 between a loading station 100 and stacking mechanism 2. Belts 5, 6 are guided freely between roller 7, disposed at stacking mechanism 2, and stationary roller 8. In addition to roller 7, stacking mechanism 2 includes further rollers, by way of which belts 5 and 6 are guided to ensure that the letters are stacked securely. During the stacking process, stacking mechanism 2 is moved in the direction of stack 3. In this context, the length of transport path 9 is a function of the momentary position of stacking mechanism 2. The length is shortened proportionally as the letter stack grows. Conversely, the path reaches its maximum length if there is no letter stack and stacking mechanism 2 is directly situated at separating mechanism 1. As illustrated in FIG. 2, if a thin letter is situated between two thick letters in transport path 9, the thin letter is not held securely by the belts.

Figure 3:
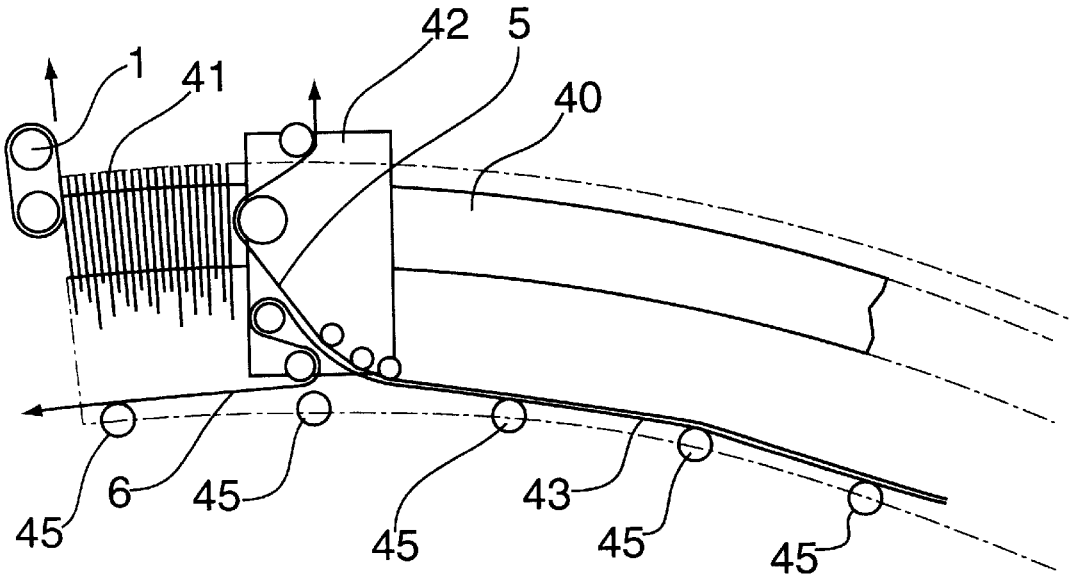
FIG. 3 shows an apparatus according to the invention having a curved stacking surface.

FIG. 3 illustrates the basic design of an apparatus according to the invention, having a curved stacking surface 40 that serves as the base for the letter stack. The letter stack is located between separating mechanism 1 and stacking mechanism 42, the latter being movable along stacking surface 40. The two belts 5 and 6 are guided by way of a plurality of rollers 45, and form a curved transport path 43. In the region of transport path 43, the belts are deflected multiple times around rollers 45. In this context, the distance between the rollers is selected to be small enough to enable the letters to be held securely. Deflecting rollers 45 are all disposed on the same side of belt pair 5, 6 in the region of the transport path, so that the length of the transport path is infinitely adjustable when stacking mechanism 42 moves along stacking surface 40. According to this embodiment of the invention, the entire apparatus in FIG. 3 is curved, i.e., stacking surface 40 and the curve on which deflecting rollers 45 are arranged have essentially the same curvature. Stack 41 and the track of stacking mechanism 42 follow the curvature of stacking surface 40.

Figure 4:
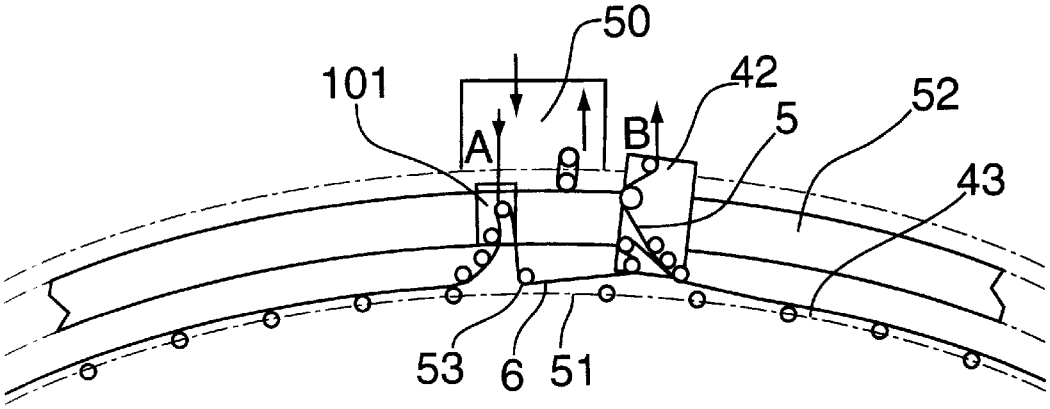
FIG. 4 shows a cutout of an annular apparatus according to the invention.

FIG. 4 illustrates an advantageous specific embodiment of the apparatus in which the apparatus is essentially annular. Due to the annular configuration of the arrangement, the endless circulation of belts 5, 6 is simplified in that outer belt 5 and inner belt 6 are returned along the shortest path in the regions 50 or 51 between loading station 101 and stacking mechanism 42. Inner belt 6 is preferably returned by way of a stationary deflecting roller 53, which is fixedly disposed on the concave side of curved stacking surface 52 in the region of loading station 101.

Figure 5:
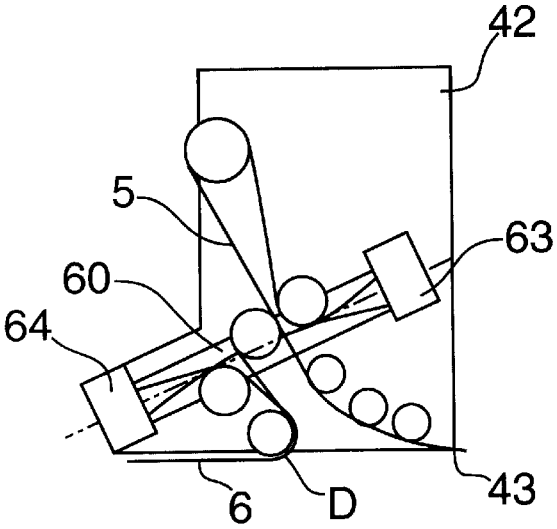
FIG. 5 shows a belt bridge.
Figure 6:
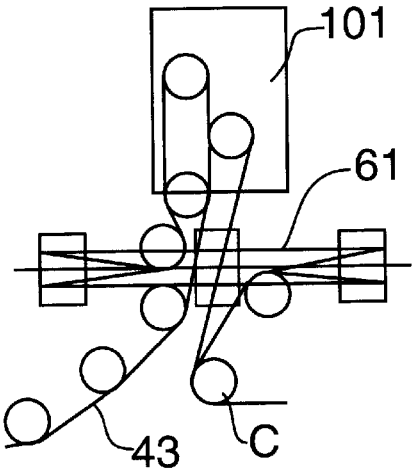
FIG. 6 shows a further belt bridge.

In a preferred specific embodiment of the invention, outer belt 5 is guided away via two belt bridges along the transport path. FIG. 5 illustrates a first belt bridge 60, which is preferably connected rigidly to stacking mechanism 42. Belts 5 and 6 are guided by way of a plurality of deflecting rollers at the stacking mechanism, with outer belt 5 being rotated and rotated back, respectively, in its orientation by 90° by two horizontal rollers 63, 64. Belt 5 can be guided above or below transport path 43. FIG. 6 illustrates a similar belt bridge 61 for crossing above or below the transport path in the region of loading station 101. The belt bridges permit the return of outer belt 5 on the concave side of stacking surface 52. Therefore, the outer belt can be guided back with inner belt 6 between points C and D by way of the same deflecting rollers that are also used by the transport path, and by deflecting roller 53.

Figure 7:
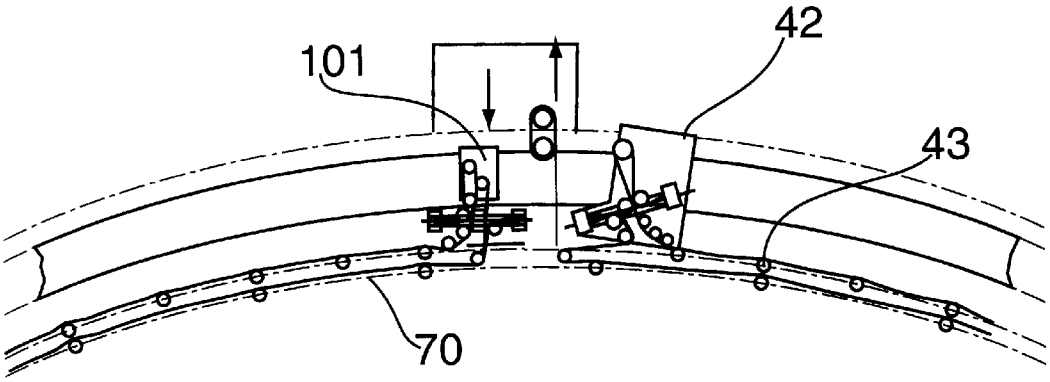
FIG. 7 shows an alternative belt guide for an apparatus according to the invention.

FIG. 7 illustrates an advantageous embodiment of the invention in which belts 5, 6 are returned by way of additional deflecting rollers. These deflecting rollers are essentially disposed on a ring 70 inside transport path 43. This arrangement allows endless belts 5, 6 to be exchanged, even if the entire apparatus is set up around a column, for example.

Figure 8:
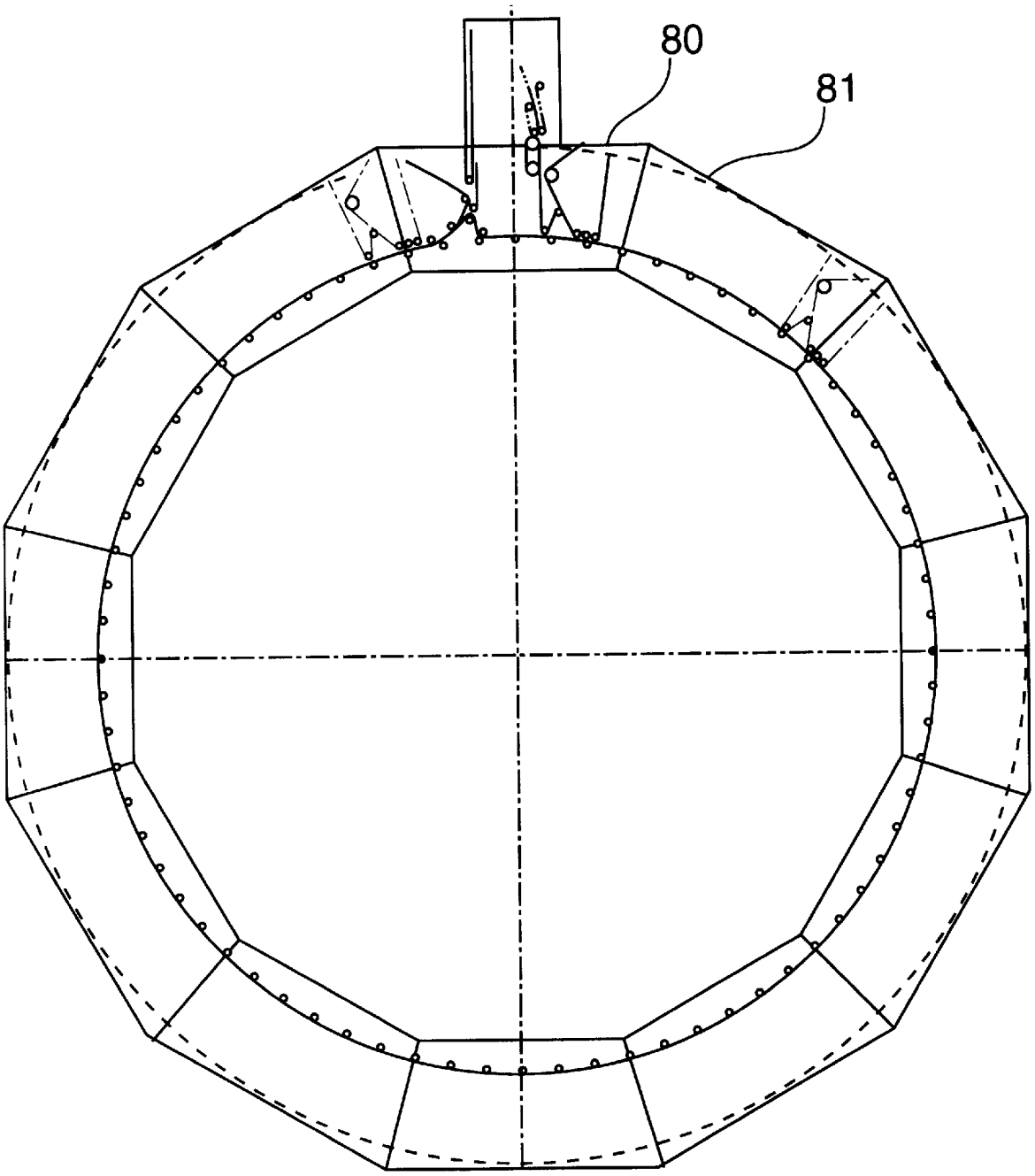
FIG. 8 shows a ring storage element with segments.

FIG. 8 illustrates a preferred embodiment of the apparatus that is constructed from a plurality of similar segments 81, with the exception of the region of the loading station and separating mechanism 80.

We claim:

1. An apparatus for stacking flat sheets, comprising a separating mechanism and a stacking mechanism between which mechanisms the sheets are stacked, the stacking mechanism being movable in a stacking direction along a stacking surface, the apparatus further comprising a transport path formed by endless belts guided by rollers, between which belts the sheets are transported from a loading station to the stacking mechanism, wherein the stacking surface has a curvature concave with respect to a side on which the transport path is located, and the belts are deflected in the region of the transport path by a plurality of deflecting rollers that are disposed on a curve having a curvature essentially the same as the curvature of the stacking surface, such that the transport path has a curvature essentially the same as the curvature of the stacking surface, the belts being arranged between the stacking surface and the deflecting rollers in the region of the transport path.

2. An apparatus as defined in claim 1, wherein the stacking surface is essentially annular.

3. An apparatus as defined in claim 2, wherein the stacking surface comprises a plurality of segments.

4. An apparatus as defined in claim 2 wherein the stacking surface is configured essentially as a rigid disk.

5. An apparatus as defined in claim 4 further comprising a belt bridge at each of the stacking mechanism and the loading station, by way of which bridges an outer belt is guided above or below the transport path.

6. An apparatus as defined in claim 2 further comprising a belt bridge at each of the stacking mechanism and the loading station, by way of which bridges an outer belt is guided above or below the transport path.

7. An apparatus as defined in claim 6, wherein the belts are guided back by way of the same deflecting rollers that are also used by the transport path.

8. An apparatus as defined in claim 6, wherein the belts are guided back by way of separate deflecting rollers that are disposed inside a ring formed by the deflecting rollers used by the transport path.

9. An apparatus as defined in claim 2, wherein the belts are guided back by way of the same deflecting rollers that are also used by the transport path.

10. An apparatus as defined in claim 2, comprising a plurality of essentially similar segments, except for the region of the loading station and the separating mechanism.

11. An apparatus as defined in claim 1, wherein the stacking surface comprises a plurality of segments.

12. An apparatus as defined in claim 11, wherein the belts are guided back by way of the same deflecting rollers that are also used by the transport path.

13. An apparatus as defined in claim 1 wherein the stacking surface is configured essentially as a rigid disk.

14. An apparatus as defined in claim 13 further comprising a belt bridge at each of the stacking mechanism and the loading station, by way of which bridges an outer belt is guided above or below the transport path.

15. An apparatus as defined in claim 13, wherein the belts are guided back by way of the same deflecting rollers that are also used by the transport path.

16. An apparatus as defined in claim 1 further comprising a belt bridge at each of the stacking mechanism and the loading station, by way of which bridges an outer belt is guided above or below the transport path.

17. An apparatus as defined in claim 16, wherein the belts are guided back by way of the same deflecting rollers that are also used by the transport path.

18. An apparatus as defined in claim 16, wherein the belts are guided back by way of separate deflecting rollers that are disposed inside a ring formed by the deflecting rollers used by the transport path.

19. An apparatus as defined in claim 1 wherein the belts are guided back by way of the same deflecting rollers that are also used by the transport path.

* * * * *